United States Patent [19]

Brunkow

[11] 3,988,958

[45] Nov. 2, 1976

[54] THUMB REST FOR A MUSICAL WIND INSTRUMENT

[76] Inventor: Darwin D. Brunkow, 871-66th Ave. NE., Minneapolis, Minn. 55433

[22] Filed: May 1, 1975

[21] Appl. No.: 573,755

[52] U.S. Cl. ..... 84/453; 84/380 R

[51] Int. Cl.[2] ..... G10D 3/18

[58] Field of Search ..... 84/380, 382, 384, 385, 84/453

[56] References Cited

UNITED STATES PATENTS

| | | | |
|---|---|---|---|
| 2,803,983 | 8/1957 | Dowling | 84/382 |
| 2,847,892 | 8/1958 | Laas et al. | 84/380 R |
| 2,933,968 | 4/1960 | Hearne | 84/380 R |

*Primary Examiner*—Lawrence R. Franklin
*Attorney, Agent, or Firm*—Merchant, Gould, Smith, Edell, Welter & Schmidt

[57] ABSTRACT

A body having an elongated bottom surface adapted to rest upon the thumb of a musician's hand, and a clamping screw-equipped bridge element on the top of the body for securing the body to the thumb rest usually mounted on musical wind instruments of the type including clarinets, oboes, and others.

2 Claims, 4 Drawing Figures

THUMB REST FOR A MUSICAL WIND INSTRUMENT

BACKGROUND OF THE INVENTION

This invention relates to an attachment for wind instruments, such as clarinets, which are supported mainly by the thumb and partially by the fingers, of one of the player's hands. For this purpose, clarinets, oboes, bassoons, saxophones, and the like instruments are usually provided with brackets, ordinarily called thumb rests, that project generally radially outwardly from a convenient portion of the tube of each instrument. The conventional thumb rests are quite small and, when the instrument is being held and played for extended periods of time, extreme discomfort is experienced by the musician. This is particularly true with students whose thumbs are not calloused or toughened by continuous use of the instrument.

SUMMARY OF THE INVENTION

The attachment of this invention involves a body having a mounting device thereon for mounting the body on the thumb supporting bracket or thumb rest, usually secured to the elongated tube of a musical wind instrument such as a clarinet. The body has a bottom surface for overlying engagement with the thumb of a player's hand, the bottom surface having a substantially greater thumb-engaging area than that of the thumb rest upon which the body may be mounted.

In a preferred embodiment of the invention, the thumb-engaging bottom surface of the body is elongated in a direction generally tangentially of the tube of the instrument when mounted thereon, the bottom surface curving upwardly adjacent the opposite end of the body.

DETAILED DESCRIPTION OF THE PREFERRED EMBODIMENT

Figure 4:
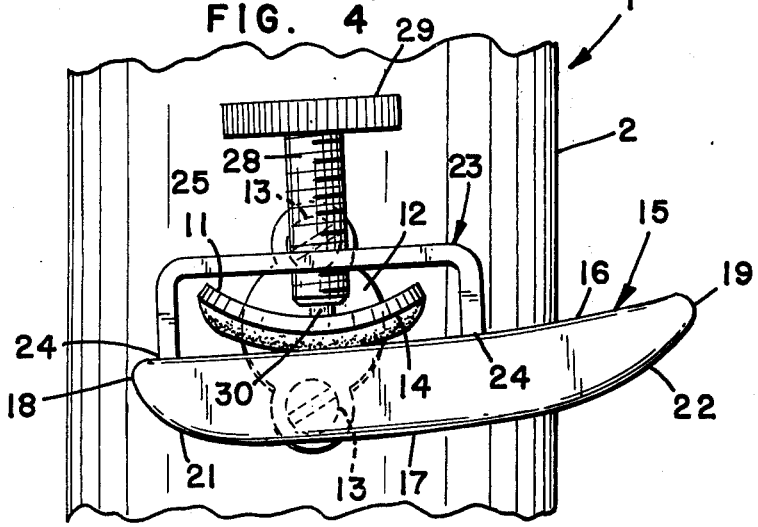
FIG. 4 is an enlarged fragmentary side elevation corresponding to a portion of FIG. 1.

In the drawings, a musical wood-wind instrument, such as a clarinet, is indicated generally by the reference 1 and is shown as comprising an elongated tube 2 having a bell 3 at one end, and a mouth piece 4 at its opposite end, the mouth piece 4 having a reed 5 mounted thereon by means of the usual clamping bracket 6. The tube 2 is shown as being provided with at least some of the openings and keys by means of which the instrument is played, the musician's right and left hands being partially shown by dotted lines and indicated at 7 and 8 respectively. The instrument is usually supported by the thumb 9 and fingers 10 of the right hand 8, the thumb 9 carrying the greater part of the weight of the instrument by engagement with a bracket or thumb rest 11 that extends generally transversely outwardly from the tube 2. The thumb rest 11 is provided with a base portion 12 that is secured to the tube 2 by screws or the like 13, see particularly FIGS. 2 and 4.

Thumb rests of the type indicated at 11 are of generally similar shape and size for different instruments of the wood-wind variety, and including saxophones and have curved thumb-engaging bottom surfaces that are sometimes covered with a cushioning layer of rubber or other material 14. The cushioning layer notwithstanding, the small size of the thumb rest 11 provides an inadequate base of support for the weight of most instruments of the instant variety. Hence, the thumb 9 of the musician's hand 8 becomes unduly fatigued and irritated when the instrument is held and played for an appreciable length of time, as for instance during a practice session. Such fatigue and irriation is experienced even though the bottom surface 14 of the thumb rest 11 is padded.

The attachment of this invention comprises a generally rectangular body 15 having top and bottom surfaces 16 and 17 respectively, opposite ends 18 and 19, and an inner edge surface 20. The bottom surface 17 is preferably smooth and, for the most part, generally flat, portions of the bottom surface adjacent the ends 18 and 19 being upwardly curved, as indicated at 21 and 22 respectively. An inverted generally U-shaped bridge element 23 is secured at its opposite ends 24 to the top surface 16 of the body 15, the bridge element 23 including an intermediate portion 25 disposed in upwardly spaced generally parallel relation to the top surface 16 of the body 15. It will be noted that the bridge element 23 is disposed closer to the end 18 of the body 15 than it is to the opposite end 19 thereof, the bridge element 23 cooperating with the body 15 to define an opening 26 of a size to freely receive the thumb rest 11 therein.

Intermediate its ends, the bridge portion 25 is provided with a screw-threaded aperture 27 for reception of locking means in the nature of a clamping screw 28 having a diametrically enlarged head 29 at its outer end. At its inner end the clamping screw 28 has a diametrically reduced portion 30 for engagement with the thumb rest 11, the clamping screw 28 being adapted to cause the thumb rest 11 to be clamped between the portion 30 and the top surface 16 of the body 15.

Figure 1:
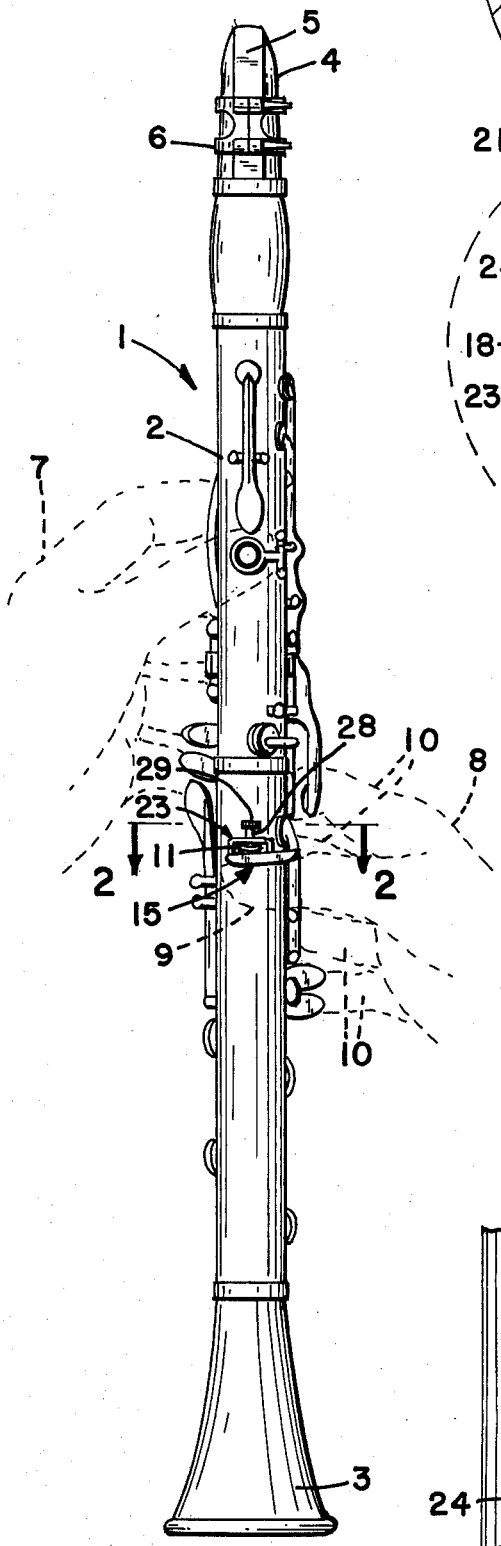
FIG. 1 is a view in side elevation of a clarinet, showing the attachment of my invention mounted thereon.
Figure 2:
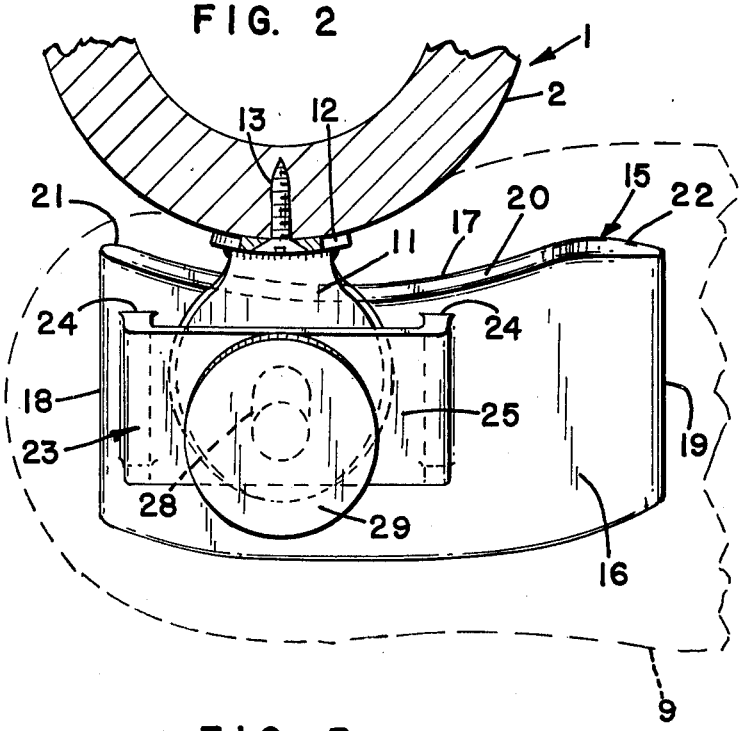
FIG. 2 is an enlarged fragmentary view partly in section and partly in top plan, taken generally on the line 2—2 of FIG. 1.
Figure 3:
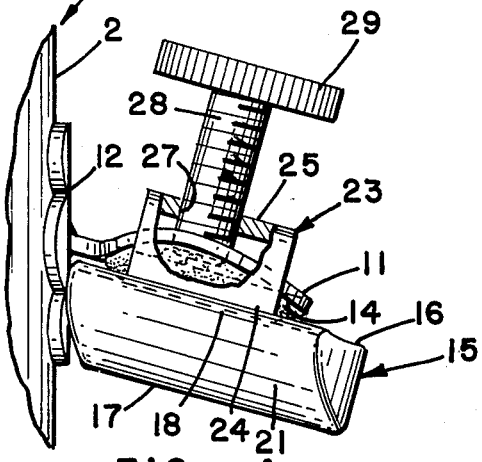
FIG. 3 is a fragmentary view in side elevation, as seen from the left to the right with respect to FIG. 1, some parts being broken away and some parts being shown in section.

As shown in FIG. 2, when the attachment of this invention is applied to the thumb rest of an instrument, the body 15 extends generally tangentially with respect to the tube 2, the arcuate inner edge surface 20 of the body 15 following, at least to some extent, the curvature of the tube 2. Further, in view of the fact that many thumb rests of the type shown at 11 are slightly curved, the space between the bridge portion 25 and the top surface 16 of the body 15 permits the body 15 to be adjusted to vary the angular relationship between the longitudinal dimension of the body 15 and that of the tube 2. By providing a body 15 with a length and width of substantially greater dimensions than those of the usual thumb rest, a substantially greater ease of support for the instrument 1 is achieved than heretofore. I have found that the instrument may be held and played for extremely long periods of time without fatigue or discomfort to the supporting hand and more particularly to the musician's supporting thumb. While I have shown and described a commercial embodiment of my attachment for musical instruments, it will be understood that the same is capable of modification without departure from the spirit and scope of the invention, as defined in the claims.

What is claimed is:

1. A thumb rest attachment for a wood-wind musical instrument, said instrument having a generally tubular body with a thumb rest fixed thereto, said attachment comprising:

a rigid body having an upper surface, a smooth bottom surface for overlying engagement with a user's thumb, and a curved side edge surface;

mounting means comprising an inverted, generally U-shaped bridge element secured to said upper surface in overlying relationship thereto and defining therewith a thumb rest receiving opening, and a clamping element threaded into the bight of said bridge element, said clamping element and said upper surface cooperating to mount said attachment to said fixed thumb rest when it is received in said opening;

said bottom surface being elongated in a direction generally tangentially with respect to said tubular body when mounted on said fixed thumb rest, said bottom surface having a length considerably longer than the width of said fixed thumb rest, and said bottom surface being generally flat for the greater part of said length and being curved upwardly adjacent the longitudinally opposite ends thereof; and said curved inner side edge surface being disposed to generally follow the cross-sectional curvature of said tubular body when said attachment is mounted on said fixed thumb rest.

2. A thumb rest attachment as in claim 1 wherein said bridge element is secured to said upper surface closer to one end thereof.

* * * * *